United States Patent [19]

Lester et al.

[11] 4,204,292

[45] May 27, 1980

[54] PORTABLE SCRUBBING TOOL

[75] Inventors: Frank R. Lester, Boynton Beach, Fla.; James Bullard, Adair, Okla.

[73] Assignee: Nuvite Chemical Compounds Corporation, Brooklyn, N.Y.

[21] Appl. No.: 944,354

[22] Filed: Sep. 21, 1978

[51] Int. Cl.[2] ..... A46B 13/02; A47L 11/162

[52] U.S. Cl. ..... 15/28; 51/180

[58] Field of Search ..... 15/28, 29, 23, 24, 21 R, 15/53 R, 98, 103; 51/180

[56] References Cited

U.S. PATENT DOCUMENTS

| | | | |
|---|---|---|---|
| 689,464 | 12/1901 | Cramer | 15/103 |
| 1,679,323 | 7/1928 | Mortlock | 15/29 |
| 2,559,295 | 7/1951 | Grossenbacher | 15/98 |
| 3,268,935 | 8/1966 | Ungeheuer | 15/21 R |
| 3,688,139 | 8/1972 | Yaguchi | 15/29 X |
| 4,102,290 | 7/1978 | Weiss | 15/24 X |

*Primary Examiner*—Edward L. Roberts
*Attorney, Agent, or Firm*—Fleit & Jacobson

[57] ABSTRACT

A lightweight pneumatic powered portable scrubbing tool is disclosed having a scrubbing brush member that is rotated by a cylindrically-shaped elongated air powered motor. The brush member has a substantially circular mounting plate and a plurality of bristles affixed to a surface of the plate. At least a portion of the bristles are adjacent the periphery of the plate and are directed at an angle outwardly therefrom. The motor shaft is affixed to the brush member and supports the brush member. The motor housing is pivotably connected to an elongated main support pole, having an air supply hose disposed therewithin and along the length thereof. The air supply hose exits from a peripheral portion of the main support pole and is interconnected with the motor. A quick-disconnect fitting is mounted on an opposite end of the main support pole, i.e., remote from the motor, for interconnection with a fluid source, or a secondary main support pole. An auxiliary support pole is interconnected with the main support pole at a preselected position along the length of the main support pole. The auxiliary support pole is extensible.

19 Claims, 10 Drawing Figures

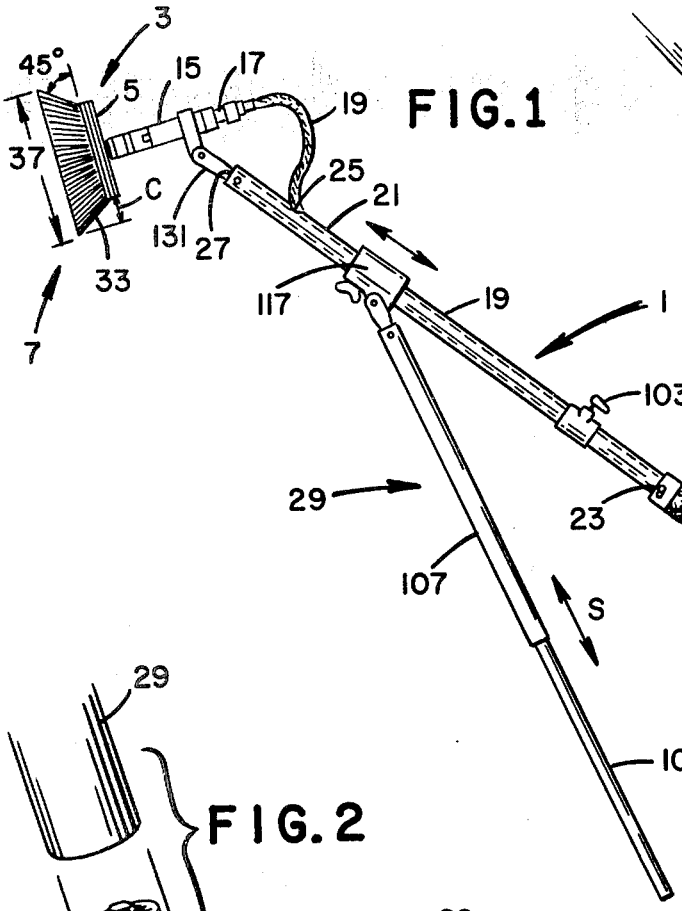
FIG. 1
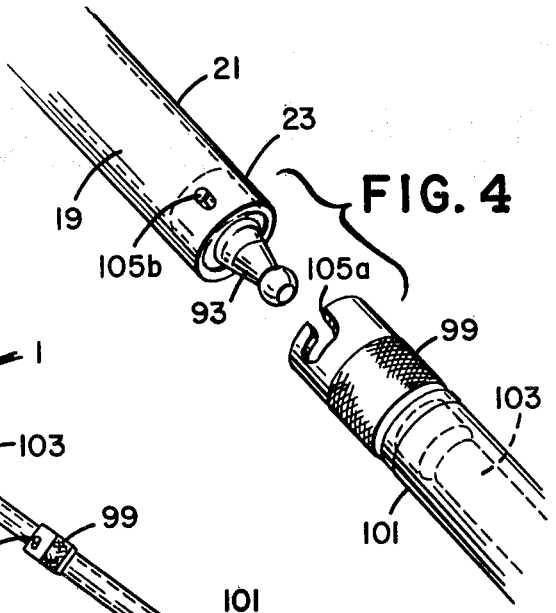
FIG. 4
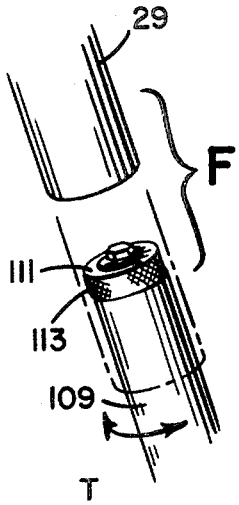
FIG. 2
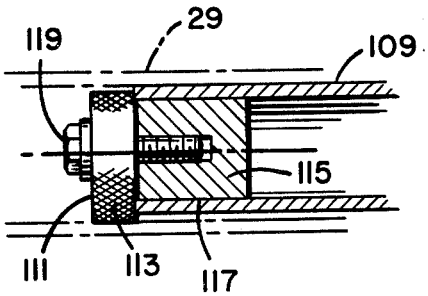
FIG. 2a
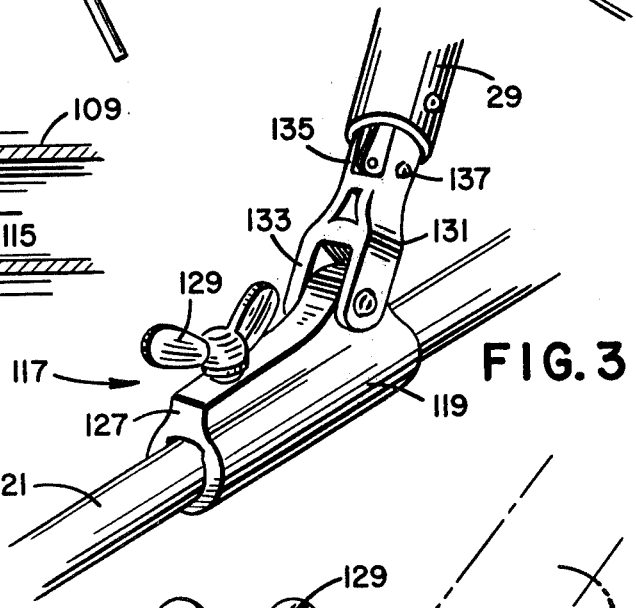
FIG. 3
FIG. 2b
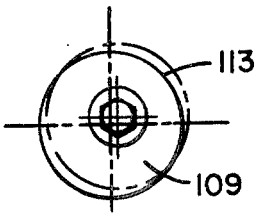
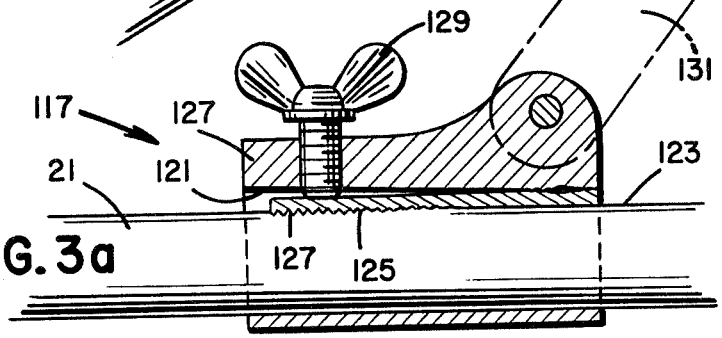
FIG. 3a

PORTABLE SCRUBBING TOOL

BACKGROUND OF THE INVENTION

The invention relates to a portable, lightweight, and easily maneuverable scrubbing tool comprising a pneumatically powered scrubbing brush interconnected with an elongated tubular, hand-held main support pole for the cleaning or scrubbing of relatively large, irregular surfaces, such as aircraft exteriors.

In the cleaning of exterior aircraft surfaces, a detergent is sprayed onto the surface of the aircraft and then, for proper cleaning, the aircraft surface must be agitated by a brush in order to break the adhesive factor of the soil to the surface. The surface is then rinsed with water for completion of the cleaning procedure. It is knwon in the art to accomplish the agitation process with hand scrub brushes that are attached to wooden handles of various sizes. The cleaning operator manually agitates the surface of the aircraft by a back and forth scrubbing action which is time consuming and inefficient.

Certain rather sophisticated apparatus for cleaning surfaces of aircraft are known, as shown in U.S. Pat. No. 3,648,316. Such a system requires a carriage that is positioned adjacent the aircraft and having extensible booms interconnected with the carriage. Such devices are complex and costly, both to manufacture and maintain.

Also known in the art are a variety of rotary brushes used for cleaning a variety of surfaces. Examples of such prior art brushes include those disclosed in U.S. Pat. Nos. 1,369,567; 2,000,930; 3,074,088; 3,153,799; and 3,864,780. The present invention has advantages over these prior art brush systems as will be apparent from the description below.

SUMMARY OF THE INVENTION

The invention relates to an improved portable scrubbing tool comprising a rotary scrubbing tool brush member powered by a pneumatic motor, or turbine, particularly an air-, or other noncombustible gas-, powered motor. The motor supports the scrubbing tool brush member and is narrowly shaped so as not to interfere with the surfaces to be cleaned during the cleaning operation. The motor and brush are interconnected with an elongated, tubular, main support pole to be held by the operator. The main support pole is pivotally connected to the motor so that the brush member and motor unit can be angularly positioned with respect to the main support pole for cleaning difficult to reach surfaces. The main support pole is interconnected with an auxiliary support pole at preselected positions along the length of the main support pole. In operation, the operator holds both the auxiliary support pole and the main support pole and maneuvers the brush onto the cleaning surface where it is rotated by the air or gas-powered motor.

It is a primary object of the present invention to provide an improved scrubbing brush tool for cleaning large structures that have irregular, or hard to reach surfaces. The invention has particular utility for cleaning the exterior surfaces of aircraft, although it can also be successfully employed in the cleaning of other large surfaces such as trucks, buses, buildings, and other commercial industrial cleaning jobs. The scrubbing tool has a brush that is particularly suited to agitate the surface of the body to be cleaned in order to break down the adhesive factor between the soil and the surface. The scrubbing tool of the present invention is easily maneuverable, portable, and of light weight in order to clean such hard to reach areas as the aircraft flap well areas, gear well areas, fuselage, landing gears, cargo compartments, etc.

It is an object of this invention to provide a light weight and easily maneuverable scrubbing tool that is capable of adjustable extensions to different positions. It is further an object of the invention to provide a safe, power-operated tool that is operated by an air or other noncombustible gas motor, specifically avoiding electrically powered motors.

It is still further an object of the present invention to provide a scrubbing tool having a brush member supported on a light weight, compact, air-powered motor, the latter being cylindrically shaped, having a length substantially greater than the diameter thereof, so that the motor can be attached to the brush member as a unit, without interfering with the surfaces to be cleaned during the cleaning operation. In particular, it is an object of the present invention to provide a motor interconnected with a brush plate, wherein the bristles are attached on the opposite side thereof, and wherein the motor is of a size so as not to extend beyond the periphery of the brush plate, and thus not interfere with the surfaces to be cleaned.

Still further, it is an object of the present invention to provide an air hose disposed within the main support pole for protecting the air hose during operation.

Another object of the present invention is to provide a portable and easily assembled scrubbing tool. In particular, an elongated main support pole is easily, and releaseably, pivotally secured to the motor housing. An auxiliary support pole is pivotally and releasably secured to the main support pole at preselected positions thereon. Still further, the present invention has as its object the use of quick-disconnect air hose fittings for fast and reliable assembly.

These and other objects of the invention will become readily apparent when reference is made to detailed description and the accompanying drawings.

BRIEF DESCRIPTION OF THE DRAWINGS

FIG. 1 is an overall side view of the portable scrubbing tool of the present invention.

FIGS. 2, **2*a*, and 2*b*** are the locking elements for locking the auxiliary support pole to the auxiliary extension pole.

FIGS. 3, and **3*a*** are the main support pole sleeve.

FIG. 4 is the quick disconnect fitting.

DETAILED DESCRIPTION OF THE DRAWINGS

Figure 5:
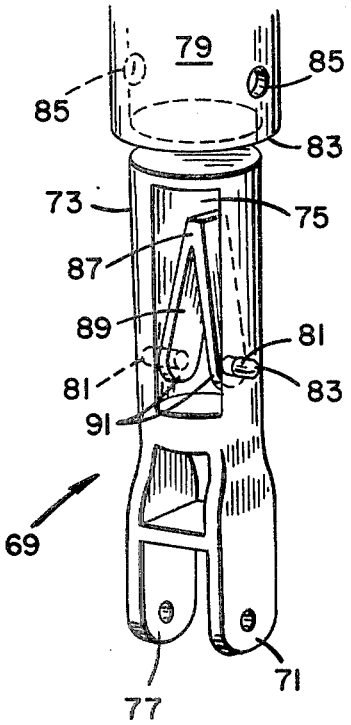
FIG. 5 is the interconnect element.
Figure 6:
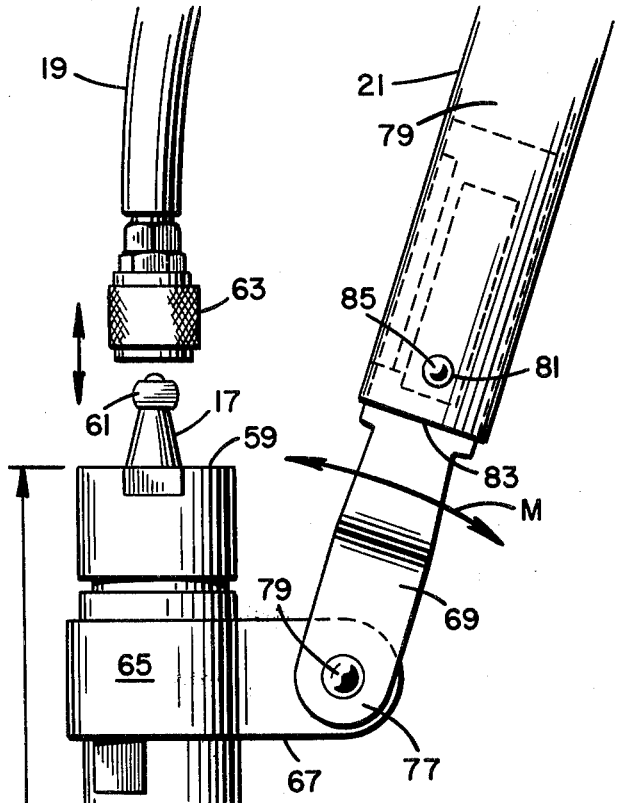
FIG. 6 is a partial sectional view of the brush member and motor.
Figure 7:
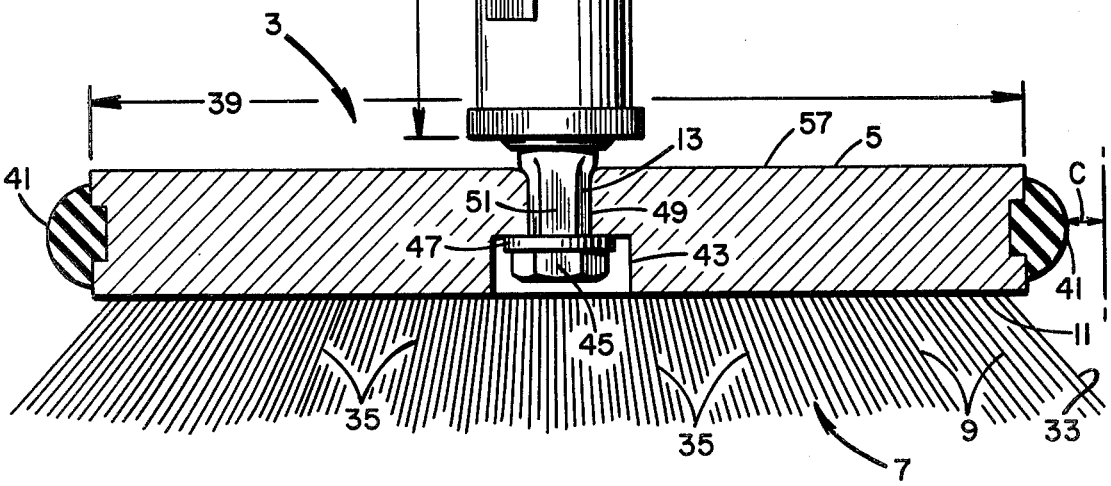
FIG. 7 is a block diagram of the scrubbing tool and air supply system.
Figure 7:
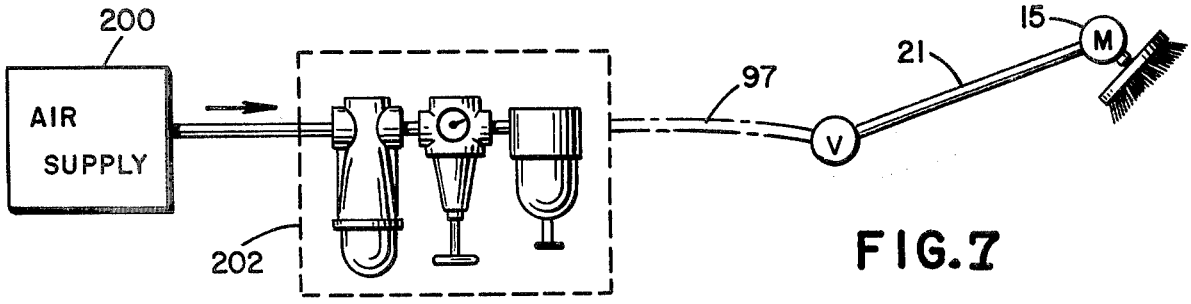

Referring to the drawings, a lightweight, portable, pneumatic powered scrubbing tool 1 is disclosed and includes a scrubbing brush member 3 having a mounting plate 5 and a brush 7 comprising a plurality of brush bristles 9 affixed to one surface 11 of the plate. The mounting plate 5 is centrally connected to a drive shaft 13 of a slim, light weight, air-, or noncombustible gas-, powered motor 15 of generally cylindrical shape. One end of the motor has a quick-disconnect male air hose fitting 17 for receiving a pneumatic fluid supply hose 19. A main support pole 21 is pivotally connected to the motor. The main support pole 21 is tubular, hollow, and has a flexible pneumatic fluid supply hose 19 extending from one end 23 of the main support pole 21 and exiting at the periphery 25 of the main support pole adjacent the other end 27. The hose 19 exits the peripheral opening 25 and is interconnected with the motor 15. An auxiliary support pole 29 is pivotally connected to the main support pole at preselected positions along the length of the main support pole, to be described further below.

The brush member 3 comprises a substantially circular plate 5 of approximately six (6) inches in diameter, as indicated by numeral 39. Peripherally mounted about the plate 5 is a bumper guard 31, made of resilient material, in order to prevent damage to the surface to be cleaned. On one surface 11 of the circular plate 5 is a plurality of brush bristles 9 that are arranged around the plate, preferably in concentric rings of varying diameter, not shown. The bristles 33, affixed adjacent the circumferential periphery of the plate, are disposed angularly, preferably at 45°, with respect to the plate, as shown in FIG. 1. The bristles 35 disposed closer to the center of the plate can also be mounted angularly with respect to the plate surface 11. The angles of the bristles 35 with respect to the plate surface 11 can be successively increased as one moves toward the center of the plate 5. By angularly inclining at least the peripheral bristles 33, it can be seen that the diameter of the brush bristles at their free end 37 is greater than the diameter of the plate 39. This affords a clearance C between the periphery 41 of the plate 5 and bumper guard 31 and the periphery of the free ends of the brush bristles. Thus, when the scrubbing tool 1 is applied to a surface to be cleaned, the plate 5 will not interfere with any irregular surfaces of the particular area being cleaned. Further, the angular inclination of the bristles enables a greater surface area to be cleaned, yet still maintaining a compact unit.

Centrally disposed on the side 11 of the plate 5, where the bristles 9 are attached, is a recess 43 to accommodate a bolt 45 and washer 47. Centrally disposed in the plate 5 adjacent the recess 43 is a hole 49 that receives the drive shaft 13 of the motor 15. The plate 5 is fixedly secured to the motor drive shaft 13 by means of bolt 45 that is sunk directly into the motor shaft 13. The bolt 45 and washer 47 prevent the plate from sliding off of the drive shaft 13. The drive shaft 13 has a flat 51. Likewise, the hole 49 in the plate 5 has a complementary flat (not shown) so that the plate 5 is prevented from moving angularly with respect to the drive shaft 13. It should be recognized that any means for fixedly interconnecting the plate 5 to the drive shaft 13 can be provided so long as the plate 5 can be easily removed from the drive shaft for cleaning or for interchanging different size brush members 3.

The brush member 3, including the plate 5 and brush bristles 9, is light weight, preferably less than six (6) pounds. The brush member 3 and the motor 15 comprise the unit that is to be positioned adjacent the surfaces to be cleaned, and thus the overall weight of the unit must be sufficiently light weight for good maneuverability.

The motor 15 is a pneumatic motor, preferably an air powered motor, although a motor powered by some other noncombustible gas under pressure can be employed. The motor 15 is lightweight and of compact size so that no portion of the motor overhangs, or extends beyond the periphery 41 of the brush plate. This enables the brush member 3 to be easily positioned in confined regions of the surface to be cleaned without the motor 15 colliding with and damaging the surfaces. This is, of course, extremely desireable when cleaning aircraft surfaces, wherein it is essential that no damage be done to critical aircraft parts adjacent to the cleaning surface.

The motor 15 is preferably a cylindrically-shaped motor having a length 53 substantially greater than the diameter 55 thereof. Preferably, the motor length 53, exclusive of the motor shaft, is approximately four inches and the diameter is approximately one inch. A typical motor that can be employed, with modification, is the motor no. 7538-A manufactured by the Aro Corporation. The horsepower of the motor can vary and is preferably between 0.15 to 0.25 Hp.

At one end of the motor 15 is the motor drive shaft 13 which permits the motor 15 to be mounted so that its major axis, i.e., along its length, is substantially perpendicular to the top surface 57 of the circular plate 5 thus minimizing any interference between the motor 15 and the surface to be cleaned. The opposite end 59 of the motor includes a quick-disconnect fitting 17, preferably a male fitting 61 for receiving a mating female fitting 63 on an air hose 19 to supply the fluid source. Such quick-disconnect fittings are well known in the art.

Surrounding the motor and fixedly secured thereto is a motor sleeve 65. The sleeve 65 may be permanently secured to the motor 15 an integral therewith, or it may be removably secured to the motor 15 by means of any suitable connection such as a screw or a bolt, not shown. The motor sleeve 65 has, integral therewith, a radially extending flange 67. The flange 67 is adapted to be pivotally connected to an interconnect element 69 to be described further below. The interconnect element 69 is in turn releasably connected to the main support pole 21, in a manner to be described below.

The interconnect element 69 is a unitary element, preferably made of plastic, having a U-shaped bracket 71 integral with a cylindrical rod 73 that is hollow 75 in part. The U-shaped bracket 71 has a pair of legs 77 that are positioned over the radial flange 67 of the motor sleeve 65. A bolt 79 interconnects the legs 77 of the U-shaped bracket 71 to the radial flange with a loose fit to permit rotary or pivotable movement M. Preferably, the interconnect element 69 must pivot, or rotate with respect to the major axis of the motor 15 at least 45°.

The cylindrical rod 73, integral with the U-shaped bracket 71, is adapted to fit within a hollow portion 79 of the tubular main support pole 21. On the cylindrical rod 73 are a pair of pins or nipples 81 radially extending from the rod 73, preferably at 180° apart. These nipples 81 can be manually retracted toward the interior, or hollow part 75, of the cylindrical rod 73 by manual finger pressure. The nipples 81 are rounded at 83 and are biased outwardly in a manner to be described further below. When the cylindrical rod 73 is inserted into the main support pole 21, the nipples 81 are retracted by means of abutment against the edges 83 of the main support pole 21 and thereafter the nipples 81 expand to mate with a pair of holes 85 similarly positioned near the end of the main support pole 21. The nipples 81, when positioned in the holes 85 permit the interconnect member 69 to be fixedly, yet releasably, secured in the main support pole 21. When the interconnect member 69 is to be disconnected from the main support pole 21, the operator merely applies finger pressure against the nipples 81 while at the same time moving the pole 21 relative to the interconnect member 69, thus disengaging the nipples 81 from the holes 85.

The nipples 81 are part of an outwardly biased spring 87 positioned within the hollow space 75 within the cylindrical rod 73. The spring 87 is a V-shaped member 89 wherein the nipples 81 are disposed at the free ends 91 of the V. The V-shaped member 89 is resilient thus biasing the nipples 83 outwardly when inserted in the cylindrical rod 73.

The main support pole 21 is a hollow, tubular pole, preferably of aluminum, and is of a sufficient length to enable the operator to reach remote areas of the surface to be cleaned. A five (5) foot long pole is preferable. Disposed within the pole 21 is a flexible pneumatic fluid conveying hose 19, such as an air hose. The air hose 19 extends from one end 23 of the tubular pole 21, through the length of the pole 21, and exits at an opening 25 on the periphery of the pole 21. The opening 25 is adjacent the end 27 of the pole that is to be interconnected to the motor 15. The air hose 19 has a fitting 63 that is adapted to mate with the quick-disconnect fitting 17 on the motor 15. The opposite end of the hose 19 also has a quick-disconnect fitting 93 to mate with either a fitting 95 attached to a main pneumatic fluid supply hose 97, which is not specifically depicted in the drawings, or with a fitting 99 as part of a secondary main support pole 101, as shown in FIG. 1 and described further below. The quick-disconnect fitting 93 connected with the hose 19, is mounted at the end 23 of the main support pole 21. Preferably, the quick-disconnect fitting 93 is a male fitting. A suitable and conventional shut-off valve 103 is provided adjacent this fitting 93 so that the operator can selectively supply or shut-off a source of fluid to start or stop the motor 15. Any conventional shut-off valve can be used and is conventionally interconnected with the hose 19.

It should also be recognized that a gripping surface, or shoulder element, not shown, could be disposed around the periphery of the pole 21 adjacent the end 23 for ease of handling by the operator.

In the event that a longer main support pole is required in order to reach remote positions of the cleaning surface, a secondary main support pole 101 can be optionally utilized, as shown in FIG. 1. This secondary support pole 101 is an elongated, hollow, preferably aluminum, pole having a hose 103 extending along the entire length thereof. Quick-disconnect fittings 95,99 are provided at each end of the hose and mounted on opposite ends of the secondary support pole 101. The operator can simply add to the length of the main support pole by snapping in a secondary support pole 101 as his needs require. Clearly a number of additional support poles can be used depending upon the length required by the operator. Note that a bayonet-type connection 105*a*, 105*b*, can be provided to interconnect the main support pole 21 and the secondary main support pole 101, as is conventionally known in the art.

The quick-disconnect fitting 95, or 93 if no secondary main support pole is utilized, is adapted to be connected to a main supply hose 97, which in turn is connected to an air-supply compressor 200 to receive the fluid under pressure. Preferably, when using an air-powered motor, the compressor 200 should be connected to a so-called combination unit 202 that comprises a regulator, filter and lubricant source. The compressor 200 is regulated by the combination unit 202 so that the motor 15 will operate at no more than a preselected rate. For example, it is preferable that the motor 15 operate at no more than 200 psi per minute. This will be sufficient to provide efficient cleaning, yet with no damage to the aircraft or the surrounding areas by splattering. The lubricant is supplied and passed along with the air so that the air motor can be operated efficiently and not burn out. The combination unit is a conventional unit manufactured by the Aro Manufacturing Company.

An auxiliary support pole 29 is provided and is releasably and pivotally secured to the main support pole 21. The auxiliary support pole 29 is an elongated hollow tube 107 similar to the main support pole 21, and is preferably made of aluminum. Slidably disposed within the auxiliary support pole 107 is an auxiliary extension pole 109. The auxiliary extension pole 109 is an elongated tube of diameter slightly less than the inner diameter of the auxiliary support pole 107. The auxiliary extension pole 109 can be slidably removed from the auxiliary support pole 107, as shown at S in FIG. 1, to a preselected position. The auxiliary extension pole 109 can be locked at any preselected position by means of a twisting action T, shown in FIG. 2. This locking is provided by means of a hub 111 having a knurled periphery 113 and eccentrically mounted in a plug 115 securely disposed in the end 117 of the extension pole 109. The knurled hub 111 is screwed into the plug by screw 119. When a locking action is required, the operator twists the auxiliary support pole 29 and the auxiliary extension pole 109 relative to each other, as shown as T, thus slightly unscrewing the extension pole 109 from the knurled hub 111. Because of the eccentric mounting, the extension pole 109 will be shifted within the auxiliary support pole 29 during this unscrewing action and will engage the inside surface of the auxiliary support pole 29. Other types of locking arrangements can be employed.

The auxiliary support pole 29 is pivotably connected with the main support pole 21 by means of a main support pole sleeve 117 that surrounds a portion of the main support pole 21. The main support sleeve 117 is a cylindrical sleeve 119, preferably plastic, disposed around the main support pole 21 with its inner diameter 121 at one end slightly greater than the outer diameter of the main support pole 21. Hingedly attached to the inside surface at 123 of the cylindrical sleeve is a gripping member in the form of a flap 125 that is hingedly connected at 123 to an inside surface of the cylindrical sleeve. The flap 125 may be a unitary element with the sleeve 117. The flap 125 has a gripping portion 127 that is adapted to abut against the main support sleeve 21. The main support sleeve has a radially extending flange portion 127 extending from the cylindrical sleeve 119 directly radial with the hinged flap 125. A wing nut 129 is provided that radially extends through the flange 127 and is adapted to exert pressure upon the flap 125 to urge the gripping portion 127 into gripping relationship with the main support pole 21. Thus, the operator will preselect the position that the main support sleeve 117 is to be positioned on the main support pole 21, and then tighten the wing nut 129 to secure the sleeve 117 at that position.

Pivotally connected to the flange 127 of the main support sleeve 117 is an interconnect element 131 that is identical in construction with the interconnect element 69 discussed above. The interconnect element 131 is a unitary element comprising a U-shaped bracket 133 unitary with a cylindrical rod 135. The cylindrical rod 135 is adapted to fit within the auxiliary support pole 29 and is secured therein by radially extending pins or nipples 137 that are biased outwardly from the cylindrical rod 135 in the same manner as discussed above with reference to interconnect element 69.

To use the above described scrubbing tool 1, the operator will hold the main and auxiliary support poles 21 and 29 in separate hands, and apply the brush member 3 to the surface to be cleaned. The pivotable movement of the main support pole 21 to the motor 15 which in turn supports the brush plate 5, and the pivotable connection between the main support pole 21 and the auxiliary support pole 29 permit a highly maneuverable positioning of the brush adjacent difficult to reach and irregularly shaped surface areas. Moreover, regardless of the relative position of the motor 15 and main support pole 21, the slim compact motor size will not interfere with any irregularly shaped surfaces on the surface to be cleaned.

The above description is illustrative only, and the invention is not to be limited except by reason of the following claims.

What is claimed is:

1. A lightweight, portable, pneumatic powered scrubbing tool comprising a scrubbing brush member having a substantially circular mounting plate, and a plurality of bristles affixed to one surface of the plate, at least a portion of said bristles affixed to said plate adjacent the periphery thereof and directed at an angle outwardly therefrom, a pneumatic powered motor having a motor drive shaft connected to said plate for rotating said plate, said motor positioned adjacent the other surface of said plate, and of a size so as not to extend beyond the periphery of said plate, an elongated, tubular, main support pole, means for pivotally connecting one end of said main support pole to said motor, a flexible pneumatic fluid supply hose within said main support pole extending from the other end of said main support pole and through an opening defined in a peripheral portion of the main support pole and connected to said motor, said opening located adjacent said one end of the main support pole, a quick-disconnect pneumatic fitting connected to said fluid supply hose, said fitting mounted at the other end of said main support pole, an elongated, tubular, auxiliary support pole, and means for pivotally connecting said auxiliary support pole to said main support pole, whereby said main support pole and said auxiliary support pole are adapted to be simultaneously and manually held by an operator during a scrubbing operation.

2. The scrubbing tool as claimed in claim 1 wherein said motor comprises a compressed air-powered motor of substantially cylindrical shape, wherein the length of said cylindrically-shaped motor is substantially greater than its diameter, and wherein the diameter of said motor is substantially less than the diameter of said mounting plate, said motor drive shaft extending from one end of the motor along its major axis, and fixedly connected to said plate for rotation thereof, said major axis of said motor extending substantially perpendicular to said plate.

3. The scrubbing tool as claimed in claim 2 wherein said motor includes an air inlet comprising a quick-disconnect male fitting extending along the major axis of said motor, said male fitting connected to said flexible fluid supply hose.

4. The scrubbing tool as claimed in claim 2 wherein said means for pivotally connecting said one end of said main support pole to said motor comprises a motor sleeve fixedly secured to said motor around the circumference thereof, said motor sleeve including a radial flange, a first interconnect means for interconnecting said motor sleeve with said main support pole comprising a U-shaped bracket unitary with a cylindrical rod, said U-shaped bracket pivotally connected to said radial flange, said cylindrical rod releasably secured within a hollow, tubular portion of said main support pole at said one end of the main support pole.

5. The scrubbing tool as claimed in claim 4 wherein said cylindrical rod comprises a pair of manually rectractable retaining nipples radially extending therefrom, substantially 180° apart, said main support pole defining a pair of holes for receiving said retaining nipples when said cylindrical rod is inserted in said hollow tubular portion of said one end of the main support pole.

6. The scrubbing tool as claimed in claim 5 wherein said manually retractable retaining nipples are unitary with a V-shaped spring element, said spring element disposed within said cylindrical rod such that said retaining nipples project radially from within said cylindrical rod through holes defined therein.

7. The scrubbing tool as claimed in claim 1 wherein said means for pivotally connecting said auxiliary support pole to said main support pole comprises a main support pole sleeve surrounding a portion of said main support pole and having a radial flange, means for securing said main support pole sleeve to said main support pole at pre-selected positions along the length of said main support pole, and means for pivotally connecting said radial flange with said auxiliary support pole.

8. The scrubbing tool as claimed in claim 7 wherein said means for securing said main support pole sleeve to said main support pole comprises a gripping member hingedly connected to said main support pole sleeve at a surface of the main support sleeve adjacent said main support pole, and means for urging said gripping member into gripping contact with said main support pole.

9. The scrubbing tool as claimed in claim 7 wherein said means for pivotally connecting said radial flange with said auxiliary support pole comprises a second interconnect means comprising a U-shaped bracket unitary with a cylindrical rod, said U-shaped bracket pivotally connected to said radial flange, said cylindrical rod releasably secured within a hollow portion of said auxiliary support pole at one end thereof.

10. The scrubbing tool as claimed in claim 9 wherein said cylindrical rod comprises a pair of manually rectractable retaining nipples radially extending therefrom, substantially 180° apart, said auxiliary support pole defining a pair of holes for receiving said retaining nipples when said cylindrical rod is inserted in said hollow portion of said one end of the auxiliary support pole.

11. The scrubbing tool as claimed in claim 10 wherein said manually retractable retaining nipples are unitary with a V-shaped spring element, said spring element disposed within said cylindrical rod such that said retaining nipples project radially from within said cylindrical rod through holes defined therein.

12. The scrubbing tool as claimed in claim 1 further comprising an elongated auxiliary extension pole positioned within said auxiliary support pole, and means for selectively locking said auxiliary extension pole to said auxiliary support pole at pre-selected positions thereof.

13. The scrubbing tool as claimed in claim 1 wherein said main support pole includes a pneumatic control valve mounted adjacent said other end of said main support pole.

14. The scrubbing tool as claimed in claim 1 further comprising a secondary main support pole for interconnection with said main support pole, comprising an elongated hollow pole, a second flexible pneumatic fluid supply hose within said hollow pole and extending between the ends thereof, and quick-disconnect pneumatic fittings connected to opposite ends of said second fluid supply hose and mounted at the ends of said hollow pole.

15. A lightweight, portable, highly maneuverable, pneumatic powered scrubbing tool for scrubbing remote and irregularly shaped aircraft surfaces comprising a scrubbing brush member having a substantially circular mounting plate, and a plurality of bristles affixed to one surface of the plate, at least a portion of said bristles affixed to said plate adjacent the periphery thereof and directed at an angle outwardly therefrom, a compressed air-powered motor having a motor drive shaft connected to said plate for rotating said plate, said motor positioned adjacent the other surface of said plate, and of a size so as not to extend beyond the periphery of said plate so that said motor will not interfere with the surface to be scrubbed, said motor drive shaft extending from one end of the motor along its major axis, and fixedly connected to said plate for rotating said plate, said major axis of said motor extending substantially perpendicular to said plate, an elongated, tubular, main support pole, means for pivotally connecting one end of said main support pole to said motor so that said main support pole and motor are freely pivotable with respect to each other in use, a flexible pneumatic compressed-air supply hose within said main support pole extending from the other end of said main support pole and through an opening defined in a peripheral portion of the main support pole and connected to said motor, said opening located adjacent said one end of the main support pole, a pneumatic fitting connected to said supply hose, said fitting mounted at the other end of said main support pole, and a secondary main support extension pole for interconnection with said main support pole, comprising an elongated hollow pole, a second flexible pneumatic compressed-air supply hose within said hollow pole and interconnected with said pneumatic fitting for fluid communication with said first supply hose, said secondary extension pole coaxial with said main support pole.

16. A scrubbing tool as claimed in claim 15, wherein said motor is of substantially cylindrical shape, wherein the length of said cylindrically-shaped motor is substantially greater than its diameter, and wherein the diameter of said motor is substantially less than the diameter of said mounting plate.

17. A scrubbing tool as claimed in claim 16 wherein the diameter of said mounting plate is approximately six times the diameter of said cylindrically-shaped motor.

18. A scrubbing tool as claimed in claim 15 or claim 16, wherein said means for pivotally connecting one end of said main support pole to said motor comprises a motor sleeve fixedly secured to said motor around the circumference thereof, said motor sleeve including a radial flange, a first interconnect means for interconnecting said motor sleeve with said main support pole comprising a substantially U-shaped bracket unitary with a cylindrical rod, said U-shaped bracket pivotally connected to said radial flange, said cylindrical rod secured within a hollow portion of said main support pole at said one end of said main support pole.

19. A scrubbing tool as claimed in claim 15, wherein said main support pole is free of any liquid supply tubes for supplying cleaning fluid to the scrubbing brush member.

* * * * *